US005373481A

United States Patent [19]

Orban et al.

[11] Patent Number: 5,373,481

[45] Date of Patent: Dec. 13, 1994

[54] SONIC VIBRATION TELEMETERING SYSTEM

[76] Inventors: Jacques Orban, 3215 Rifle Gap Dr., Sugar Land, Tex. 77478; Roy Squire, 5919 Pine Arbor La., Houston, Tex. 77066

[21] Appl. No.: 86,567

[22] Filed: Jul. 6, 1993

Related U.S. Application Data

[63] Continuation of Ser. No. 823,239, Jan. 21, 1992, abandoned.

[51] Int. Cl.[5] ..... G01V 1/40

[52] U.S. Cl. ..... 367/82; 367/157; 340/854.4; 340/855.4

[58] Field of Search ..... 367/82, 165, 173, 175, 367/157, 176, 912; 310/328, 334; 340/854.4, 855.4, 855.5, 855.6, 855.7

[56] References Cited

U.S. PATENT DOCUMENTS

| | | | |
|---|---|---|---|
| 2,910,133 | 10/1959 | Hudson et al. | 367/82 |
| 2,957,159 | 10/1960 | Fitchette | 340/854.6 |
| 3,233,674 | 2/1966 | Leutwyler | 367/82 |
| 3,252,225 | 5/1966 | Hixson | 33/307 |
| 3,588,804 | 6/1971 | Fort | 367/82 |
| 3,697,940 | 10/1972 | Berka | 367/82 |
| 3,900,827 | 8/1975 | Lamel et al. | 367/82 |
| 3,930,220 | 12/1975 | Shawhan | 367/82 |
| 4,038,632 | 7/1977 | Parker | 367/82 |
| 4,066,995 | 1/1978 | Matthews | 367/82 |
| 4,073,341 | 2/1978 | Parker | 367/82 |
| 4,139,836 | 2/1979 | Chaney et al. | 367/82 |
| 4,283,779 | 8/1981 | Lamel | 367/82 |
| 4,283,780 | 8/1981 | Nardi | 367/82 |
| 4,293,936 | 10/1981 | Cox et al. | 367/82 |
| 4,302,826 | 11/1981 | Kent et al. | 367/82 |
| 4,314,365 | 2/1982 | Petersen et al. | 367/82 |
| 4,390,975 | 6/1983 | Shawhan | 367/82 |
| 4,518,888 | 5/1985 | Zabcik | 310/334 |
| 4,562,559 | 12/1985 | Sharp et al. | 367/82 |
| 4,597,067 | 6/1986 | Bockhorst et al. | 367/82 |
| 4,698,794 | 10/1987 | Kruger et al. | 367/83 |
| 5,050,132 | 9/1991 | Duckworth | 367/82 |
| 5,056,067 | 10/1991 | Drumheller | 367/82 |
| 5,128,902 | 7/1992 | Spinnler | 367/82 |
| 5,166,908 | 11/1992 | Montgomery | 367/165 |

FOREIGN PATENT DOCUMENTS

| | | |
|---|---|---|
| 2157746 | 10/1985 | United Kingdom . |
| WO89/10572 | 11/1989 | WIPO . |
| WO89/10573 | 11/1989 | WIPO . |

OTHER PUBLICATIONS

Philips Export B. V., "PXE High-power Actuator for Electronic/Mechanical Interfacing.", *Technical Publication 165,* (Jun. 1985), Printed in the Netherlands.

*Primary Examiner*—Ian J. Lobo

[57] ABSTRACT

In accordance with illustrative embodiments of the present invention, a sonic vibration transmitter that is used, for example, in telemetering measurements made while drilling includes a body that mounts a stack of ceramic crystals which generate bursts of sonic vibrations when excited by encoded electrical signals that represent such measurements. The vibrations are coupled into a metal member of a drill string such as a drill collar by a coupling block that is held tightly between a shoulder on the metal member and the outer end of the stack of crystals by a strong spring that also permits longitudinal dimensional changes under high downhole temperatures. The sonic vibrations are sensed at a remote location on another metal member by a transducer that can be constructed substantially identical to the above-mentioned stack of crystals, of an accelerometer. The output signals of the transducer are filtered, amplified, and processed. Preferably the excitation signals are encoded digitally in accordance with repetition rate of the bursts. Adjacent pairs of such transducers can be used as repeater stations at spaced locations in the drill string to transmit signals from downhole toward the surface.

30 Claims, 5 Drawing Sheets

SONIC VIBRATION TELEMETERING SYSTEM

This application is a continuation of application Ser. No. 07/823,239 filed Jan. 21. 1992 now abandoned.

CROSS-REFERENCE TO RELATED APPLICATION

The subject matter of this application is related to commonly-assigned U.S. patent application Ser. No. 07/823,789 entitled "Method of and Apparatus for Making Near-Bit Measurements While Drilling", filed concurrently herewith.

FIELD OF THE INVENTION

The present invention relates generally to a telemetry system that is useful in connection with the transmission of measurements that are made during a well drilling process, and particularly to a telemetry system that employs sonic vibrations as a means of transmitting information in an efficient and reliable manner through steel drill string members to another telemetry system that is a part of the bottom hole assembly.

BACKGROUND OF THE INVENTION

Various systems have been proposed in connection with measuring-while-drilling (MWD) and logging-while-drilling (LWD) that use the drill string as a medium for transmitting sonic signals to the surface that represent a downhole measurement. None of these proposals are believed to have achieved any significant commercial use in the industry, and many of them no actual use at all. The principle reason why such prior systems have not been successful is believed to be that the drill string acts like a mechanical filter which significantly attenuates the sonic vibrations such that little or no useful information ever reaches the surface. In attempts to solve this problem, much research has been done on systems that employ repeaters which receive, amplify and retransmit the sonic signals at various levels in the drill string with the objective of having useful information reach the surface. However, in addition to being very expensive, systems that use repeater stations are believed to have encountered various technical difficulties. For example, the system disclosed in Matthews U.S. Pat. No. 4,066,995 issued Jan. 3, 1978 employs noise isolator subs at various points in the drill string to filter out background noise signals, and these subs create mechanical damping which does not allow operation of resonating transducers. Nardi U.S. Pat. No. 4,283,780 issued Aug. 11, 1981, and Kent et al U.S. Pat. No. 4,302,826 issued Nov. 24, 1981 use a mass/-spring resonant system excited by a piezoelectric source and directly coupled to the steel of the drill string. These devices require an electric resonating circuit for exciting the transducer, and must be fine-tuned with respect to both the electrical and mechanical systems. U.S. Pat. No. 3,103,643 issued Sep. 10, 1963 to Kalbfree requires a special drill pipe joint to be operable. Other patents such as Shawhan U.S. Pat. No. 3,930,220 (1975) suggest telemetering from downhole to the surface using the drill string and repeaters at various levels therein as discussed above, while other patents such as U.S. Pat. Nos. 3,697,940, 4,562,559 and 3,900,827 relate to similar systems. All such proposals have the disadvantage of requiring a complicated and expensive drill string.

Although transmission from bottomhole to the surface with a single sonic transmitter has not been found to be practical, applicant has found that telemetry via sonic vibrations transmitted through the steel members of the bottom hole assembly of the drill string over a relatively short communication link can be very useful, for example between a sensor sub that is positioned near the drill bit and an MWD tool that is positioned further uphole. This sensor sub is described in detail in commonly-assigned U.S. patent application Ser. No. 07/823,789, filed concurrently herewith and hereby incorporated herein by reference. The MWD tool operates to produce encoded pressure pulses in the mud stream inside the drill string which can be detected at the surface in a highly reliable manner. The metal members between the lower and upper ends of this link are typically drill collars having the same outer diameters. Attenuation of sonic vibrations is very low when using these members as a transmission medium. Indeed, it has been found that with the bit off bottom so that the background is relatively quiet, it is possible to transmit sonic vibrations and reliably detect them over a substantial distance, provided the diameters of the steel pipe members are substantially the same. Even during the drilling process, transmission over a distance of about 250 feet can be accomplished, limited primarily by the transmitting power of the system rather than attenuation of the signals or the high noise of the drilling process. The transmission properties of the drill collar steel are essentially independent of borehole conditions, and the transmitter and receiver should be operated at a frequency that is well above the frequency range of most of the noise generated by the drilling process. For example, the transmitter of the present invention operates at a resonant frequency that is above 10 KHz, and preferably as high as 25 KHz. A modulation system is employed such that a ceramic crystal transmitter produces bursts of sonic vibrations that are digitally encoded in terms of their repetition rates. The signals that are detected at the MWD tool arrive under conditions that provide a very favorable signal-to-noise ratio. It is within the scope of the present invention for such signals to be detected, amplified and then transmitted further uphole by telemetry other than mud pulse, for example by sonic repeater stations spaced axially along the drill string. New and improved sonic signal transmitter and receiver apparatus also are disclosed, as well as unique encoding and decoding systems.

A general object of the present invention is to provide a telemetering system by which measurements that are made near the bottom of a borehole are telemetered to the surface by means of modulated sonic vibrations created in the drill string members.

Another object of the present invention is to provide a system of the type described that operates at a predetermined frequency so as to be readily detectable over relatively high level background noise, for example that level of noise that is generated during the drilling process.

Another object of the present invention is to provide a sonic vibration transmitter that produces discrete bursts of vibrations which are digitally encoded in terms of repetitive rate to represent a downhole measurement.

Still another object of the present invention is to provide transmitter and receiver apparatus that are constructed and arranged to provide highly efficient coupling of sonic vibrations to and from a metal member of a drill string.

SUMMARY OF THE INVENTION

These and other objects are attained in accordance with the concepts of the present invention through the provision of a telemetering system for generating sonic vibrations and coupling them into a drill collar or the like, comprising a transmitter assembly having a body that mounts a stack of ceramic crystal elements. The elements are electrically connected in a manner such that when voltages are applied to the individual crystals, strains are produced that result in longitudinal displacements of one end of the stack. A coupling block that engages this end of the stack of crystals fits against a transverse surface on a metal drill string member, for example a drill collar. A resilient means reacts against the body in a manner such that the stack of ceramic crystal elements is biased against the coupling block, and the coupling block against said transverse wall, to produce an efficient coupling of the sonic vibrations into the metal member, even in the presence of high downhole temperatures.

To operate the transmitter, a timed sequence or series of voltage bursts are applied to the crystal assembly which causes them to generate corresponding busts of sonic vibrations. The excitation voltages preferably are digitally encoded in terms of their repetition rate so that one rate corresponds to a 1 bit and another rate to a 0 bit. The vibrations that are generated by such bursts travel through the metal members of the drill string to an uphole location where they can be detected by an identical transducer whose crystal assembly produces output voltages representative of the transmitted vibrations, or alternatively by a commercial piezoelectric accelerometer. These signals are filtered, amplified and decoded by means including a pattern recognition circuit which gives a digital form of output, and the output of this circuit is fed to a microprocessor that is used to control the operation of an associated telemetry means, such as the MWD tool described above, by which representative signals are transmitted to the surface via a conventional mud pulse telemetry. system. In the alternative, such telemetry means can be a repeater which produces corresponding bursts of sonic vibrations which travel upward in the drill string to another repeater thereabove. Each repeater includes a means to sense vibrations and produce electrical signals, which are filtered and amplified before being used to excite another crystal assembly which produces sonic vibrations that are coupled into the walls of metal members in the drill string.

In a preferred embodiment, the excitation signals are applied to the crystal elements of the transmitter at a relatively high frequency in the order of 20–25 KHz. This frequency is typically several orders of magnitude higher than the frequencies that constitute the noise frequencies of the background in which the present invention can be used, for example, a well drilling process. Thus, the signal-to-noise ratio at the receiver is very favorable so that measurement data is transmitted in a highly reliable manner through use of the present invention.

BRIEF DESCRIPTION OF THE DRAWINGS

The present invention has other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
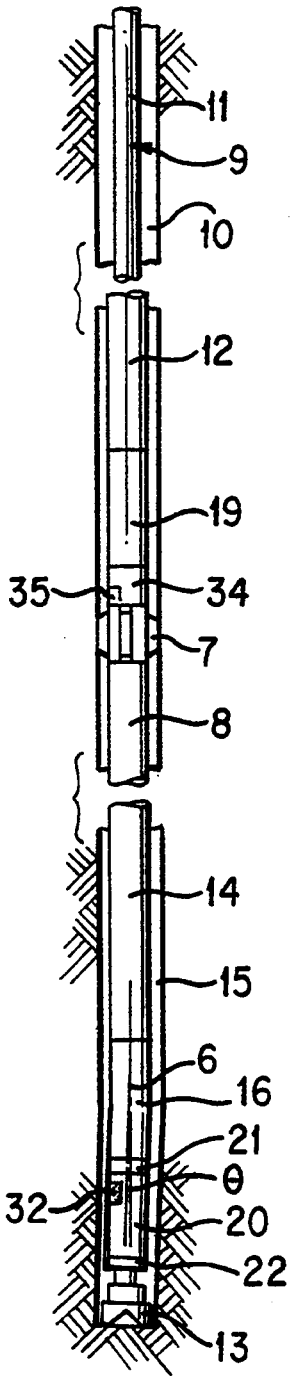
FIG. 1 is a schematic view of a measuring-while-drilling process using a telemetering system in accordance with the present invention.

As shown in FIG. 1, an environment where the present invention has application, among others, is in a well bore 10 where a drill string 9 including lengths of drill pipe 11 and drill collars 12 is suspended. A drill bit 13 at the lower end of the collar string 12 is turned by the output shaft of the power section of a mud motor assembly 14 which is powered by circulation of drilling mud down through the string 9 and back to the surface via the annulus 15. In a directionally drilled borehole, a bent housing 16 which forms a lower part of the motor assembly 14 establishes a small bend angle Θ in the string below the power section of the motor. This angle causes the borehole 10 to be drilling along a curved path in the plane of the bend to gradually establish a new or different inclination. When a bend angle is being used, and rotation of the drill string 9 is superimposed over the rotation of the motor drive shaft, the borehole 10 will be drilled straight ahead as the bend point 6 merely orbits about the longitudinal axis of the borehole. To drill straight ahead without rotation, the bent housing 16 can be adjusted either at surface, or downhole to eliminate the bend angle, the latter being accomplished with the downhole adjustable bent housing disclosed and claimed in U.S. patent application Ser. No. 649,107, filed Feb. 1, 1991, incorporated herein by reference. In the alternative, the drill string 9 can be temporarily removed to adjust the bent housing 16 by removing the bend, or replacing it with a motor having a straight housing. Of course, a bent sub (not shown) well known to those skilled in the art can be located in the drill string above the motor assembly 14 to provide the bend angle.

The drill collar portion 12 of the drill string 9 includes a sensor sub 20 that preferably is located between the upper and lower bearing assemblies 21 and 22 at the lower end of the housing of the motor assembly 14 so as to be as near to the bit 13 as is practically possible. At this location, measurements of certain borehole parameters, such as inclination and tool face, and certain geological properties of the formation such as resistivity and natural radioactivity, are made near the bit 13 and transmitted to the surface in real time. Other measurements related to motor and bit performance also can be made. Again, a full description of sensor sub 20 can be found in commonly-assigned U.S. patent application Ser. No. 07/823,789 filed concurrently herewith and incorporated earlier herein by reference.

A transmitter 32, which is housed in an enclosed cavity between inner and outer tubular members that form the sensor sub 20 and provide an atmospheric pressure environment for the transmitter and other measurement systems, functions to create sonic vibrations that are representative of the measurements made by sensor sub 20 and to couple the vibrations to the walls of the metal members. The vibrations travel upward at the speed of sound in such metal to a receiver sub 34 that is associated with an MWD tool 19 by being connected thereto or by being an integral part thereof. The MWD tool 19 is of a well known type that transmits information to the surface in the form of pressure pulses in the mud stream, and is located in the drill string 9 above the drilling motor 14. Examples of MWD tools that can be used are shown in U.S. Pat. Nos. 4,100,528, 4,103,281, 4,167,000 and 3,309,656, which are incorporated herein by reference. A typical location for the MWD tool 19 is at the upper end of a nonmagnetic drill collar 8 which is attached to the upper end of the motor assembly 14. The MWD tool 19 makes measurements similar to those mentioned above, and others; however, its measurements are sometimes being made up to 150–200 feet above the bottom of the borehole 10. Other elements such as a stabilizer 7 also can be included in the drill string 9.

Figure 2:
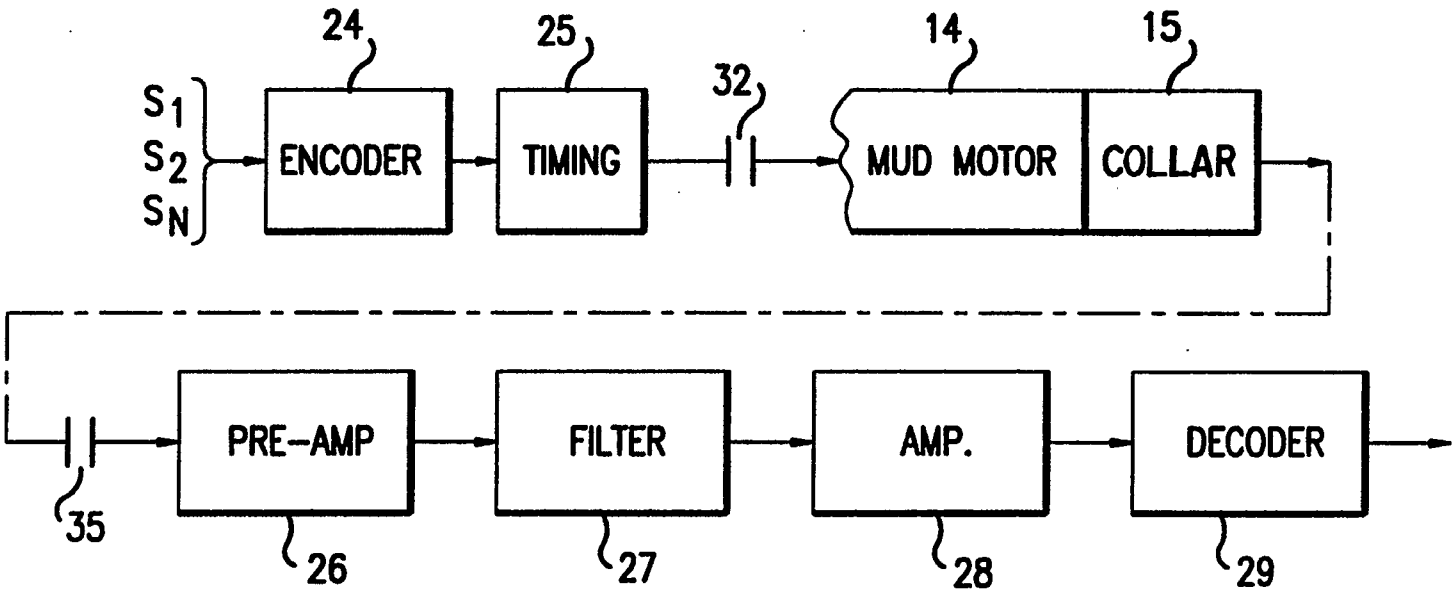
FIG. 2 is a schematic diagram of the telemetering system of FIG. 1.

In accordance with the present invention, sonic vibrations produced by the transmitter 32 are encoded or modulated according to measurements made just above the bit 13 by sensor sub 20. These vibrations travel through the walls of the various components of drill string 9 thereabove. As shown in FIG. 2, electrical signals representing the various measurements $S_1, S_2, \ldots S_N$ are fed from an encoder 24 and a timing circuit 25 which function together to provide excitation signals to the transmitter 32 which are digitally encoded in a manner that will be discussed in further detail below. The transmitter 32 includes a transducer in the form of a stack of ceramic crystals elements which generate the sonic vibrations when excited by electrical voltages. The vibrations travel upward through metal walls of the mud motor assembly 14 and the drill collar 15 located above it to the receiver sub 34 that houses a receiving transducer 35 firmly mounted in contact with the inner wall surface of receiver sub 34. The receiving transducer 35 may be constructed substantially the same as transmitter 32, but preferably is a commercial piezoelectric accelerometer such as an Endevco Model 2221F. Receiving transducer 35 responds to these vibrations and provides output signals which are preamplified at 365, filtered at filter 27, amplified at amplifier 28, and decoded at 29. The decoded signals from decoder 29 are applied to a microprocessor in the MWD tool 19 which includes a valve that operates to relay signals to the surface in the form of pressure pulses in the mud stream.

In another embodiment of the present invention, receiver sub 34 is employed as a repeater station, the output signals of which being fed to another transmitting transducer 32 that sends corresponding sonic vibrations further uphole through the metal members of the drill string 9. The process of receiving and sending by way of a repeater can be carried out at various levels in the drill string until sonic vibration signals arrive at the surface where they are detected, decoded and displayed. The sonic transducer assemblies of the present invention which now will be described in further detail.

Figure 3:
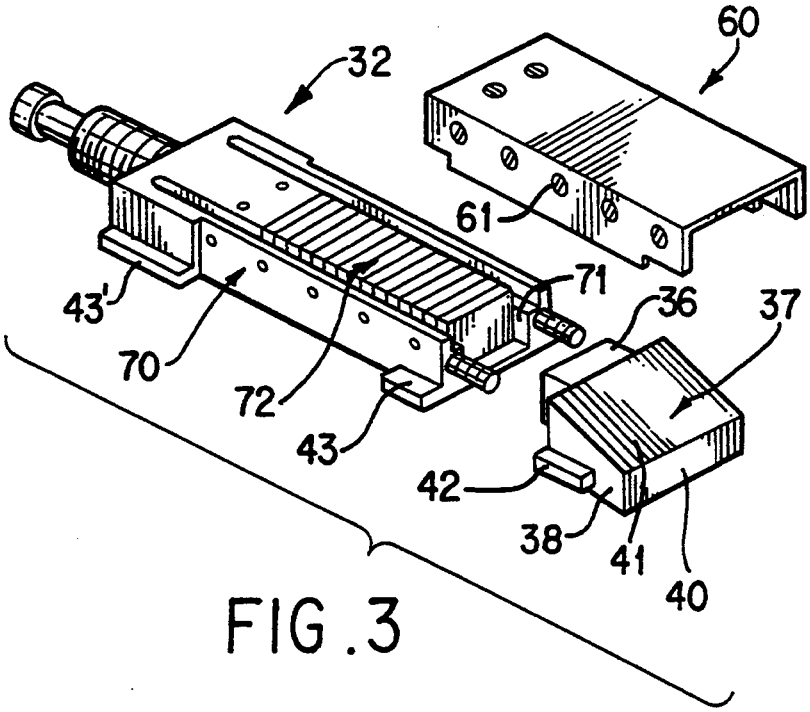
FIGS. 3 and 4 are respective exploded isometric and top views of the sonic vibration transmitter.
Figure 4:
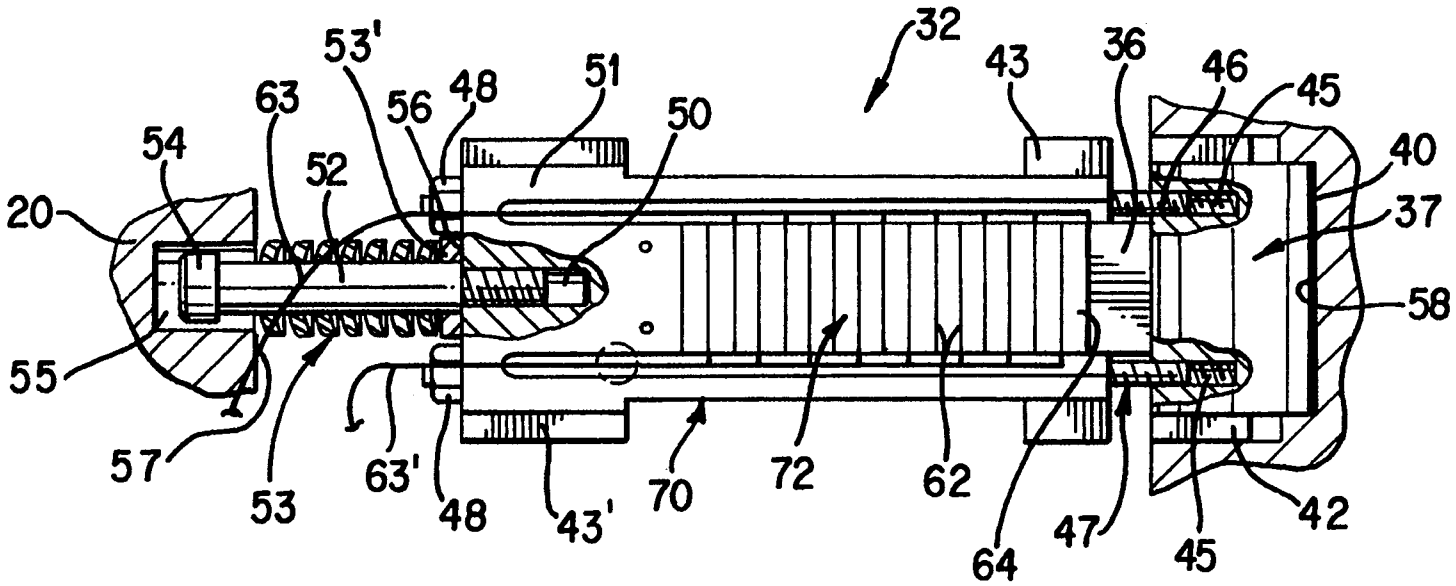

As shown in detail in FIGS. 3 and 4, the sonic transmitter assembly indicated generally at 32 includes a generally rectangular body 70 that has a longitudinal recess 71 in which is mounted a number of ceramic crystals generally indicated as 72 which are stacked side by side. The outer end of the recess 71 slidably receives the boss 36 on the rear of a coupling block 37 in a manner such that the rear wall of coupling block 37 engages the front end of the stack of crystal elements 35. The block 37 has opposite side wall surfaces 38, an outer end surface 40 and top surface 41 which can be inclined as shown. Guide lugs 42 extend outward on the sides 38 of the block 37 and are longitudinally aligned with front and rear guide lugs 43 and 43' on opposite sides of the body 70. As shown in FIG. 4, threaded holes 45 are formed in the block 37 on opposite sides of the boss 36, and the holes receive the end portions 46 of a pair of threaded rods 47 which extend through longitudinal bores in the body 70 and pass out through the rear thereof so that nuts 48 can be used to tighten the rear face of the boss 36 against the front of the stack of crystals 72. Another threaded bore 50 is formed in the center of the rear portion 51 of the body 70 and receives an elongated stud 52 having a plurality of relatively stiff springs 53, for example bellville washers, mounted thereon. The head 54 of the stud 52 extends with longitudinal play into a recess 55 in the sensor sub 20, so that the springs 53 can react between a washer 53' which rests against the rear wall 56 of the body 70 and an opposed wall surface 57 on the sub 20. The springs 53 force the body 70 upward in a manner such that the front surface 40 of the coupling block 37 remains firmly engaged against a transverse wall 58 at the upper end of the cavity in which the assembly 32 is mounted. This construction not only provides optimum sonic coupling, but also allows for slight longitudinal dimensional changes that may occur on account of high downhole temperatures. A coverplate 60 (FIG. 3) can be provided which is attached by screws 61 to the body 33.

As shown in FIG. 4, the ceramic crystals 72 are separated by thin conductive sheets 62 so that voltages can be applied to each crystal. The crystals are alternately oriented respecting their direction of polarization, and alternating ones of the sheets 62 are connected to the negative or ground lead 63, with the balance of the sheets being connected to a positive lead 63'. Voltages applied across the leads 63, 63' produce minute strains in each crystal element 72 that cumulatively effect longitudinal displacements of the front end 64 of the stack. These displacements create sonic vibrations which are coupled by the block 37 into the metal wall of the housing of the sensor sub 20, from where they travel upward through the various tubular metal members that are connected thereabove to receiver sub 34.

Figure 5A:
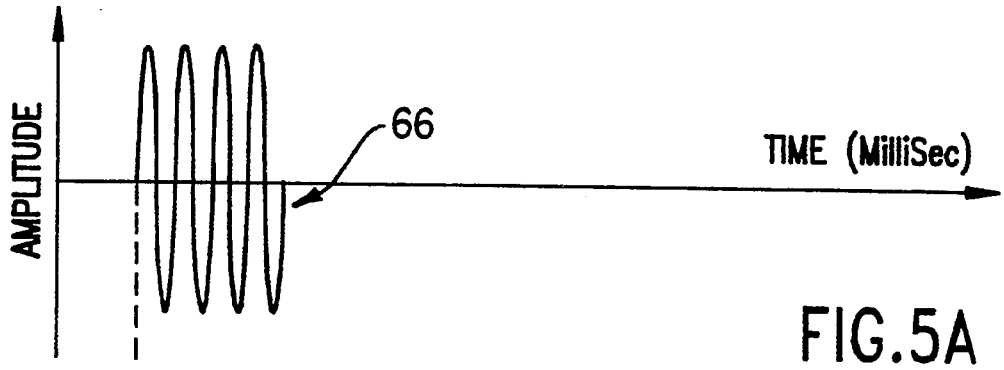
FIGS. 5A and 5B show respectively the forms of the electrical excitation of the transmitter and the sonic signals that arrive at the receiver.
Figure 5B:
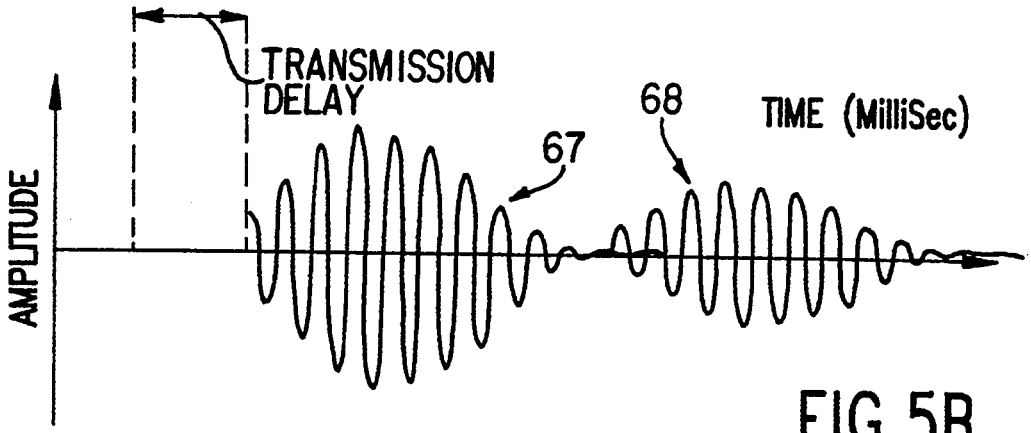
Figure 6A:
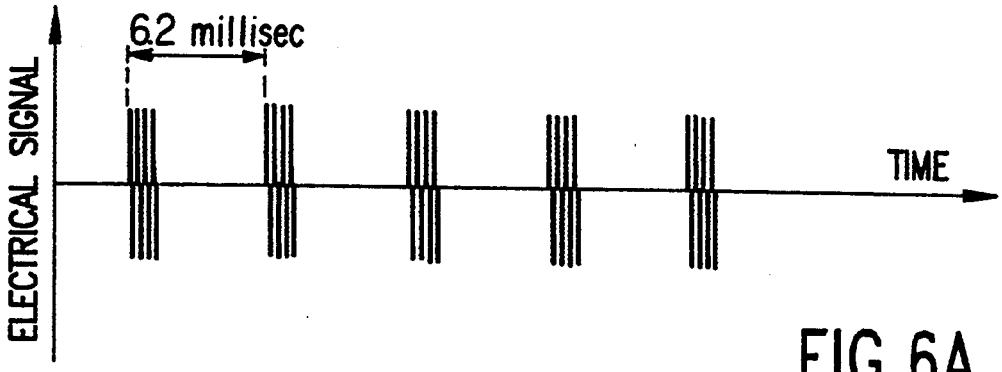
FIGS. 6A and 6B illustrate the encoded signals that operate the transmitter.
Figure 6B:
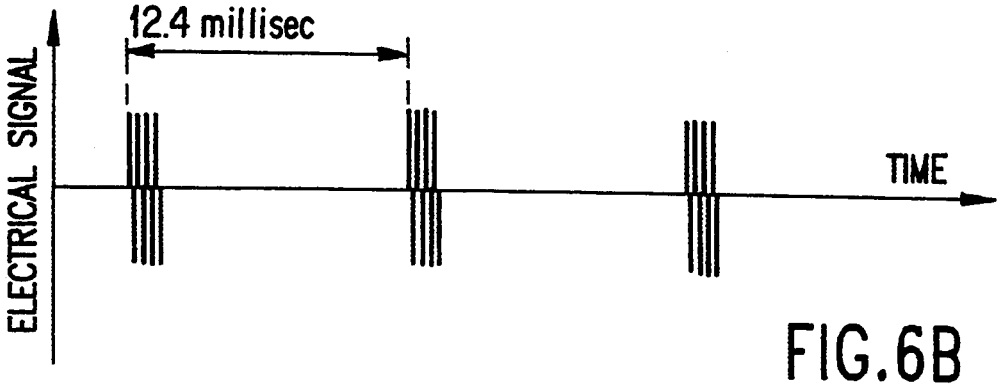

As shown in FIG. 5A, the voltages which are applied across the leads 63, 63' as a result of operation of the encoder 24 and timing circuit 25 preferably produce a form of excitation 66 having four cycles, which is a number that has been found to be optimum in the sense that maximum sonic signal amplitude is produced for a certain amount of electrical energy. This package of cycles, called herein a "burst", generates a corresponding burst of compression waves 67 and shear waves 68 in the housing of the sensor sub 20 as shown in FIG. 5B. Transverse bending waves (not shown) also may be produced. The excitation signals 66 can be encoded in various ways, but preferably digitally in terms of the repetition rates of the bursts. For example, a bit "1" can correspond to one repetition rate, and a "0" bit to another rate. As an example, 6.2 milliseconds between bursts can be the repetition rate for a bit 1 as shown in FIG. 6A, and 12.4 milliseconds between bursts for a bit 0 as shown in FIG. 6B.

Figure 7:
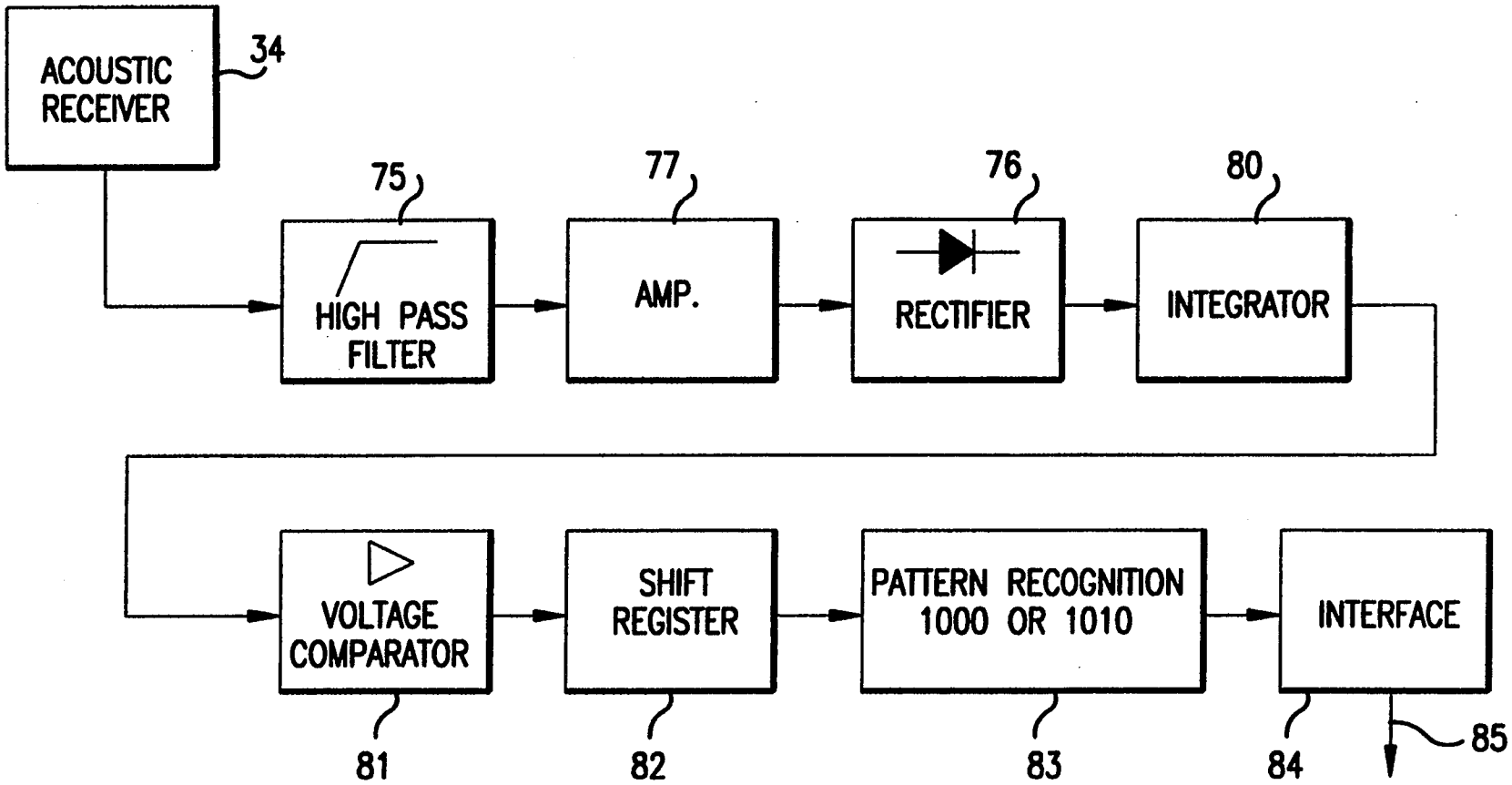
FIG. 7 is a block diagram schematic showing the circuit components that are used to decode the sonic signals at the receiver.

After a short time delay due to travel time up through the walls of the steel pipe members, the sonic vibrations arrive at the receiver sub 34 which houses a receiving transducer 35. The transducer 35 can be essentially identical to the transmitter transducer 32 described above and therefore need not be again described in detail, except to note that as a receiver, sonic vibrations applied to it result in an electric signal. In operation, the sonic vibrations coming up the drill collar 8 and into the housing of the receiver sub 34 are coupled into the coupling block 37 of the receiver transducer 35 which produce electrical output signals. In a preferred embodiment of the present invention, a conventional accelerometer is included in receiver sub 34 as the means for detecting the modulated sonic signals produced by transmitter 32 in sensor sub 20. The accelerometer, such as an Endevco Model 2221F, is firmly mounted against the outer wall of receiver sub 34 with its sensitive axis perpendicular thereto. The accelerometer is sensitive to sonic vibrations having the same frequency range as those transmitted by transmitter 32, which preferably is around 25 KHz. In either case, the output signals from receiving transducer 35 are processed and decoded as shown in FIG. 7.

The output signals from receiving transducer 35 in receiver sub 34 are fed to a filter 75 that blocks low frequency noise signals that are typically generated during the drilling process. When the "transmitter 35" type of receiver is used, filter 75 is preferably passive and the output signal is diode clamped to avoid very large and potentially damaging voltages that can be generating by the piezoelectric crystal stack when subjected to the high shocks encountered while drilling. Otherwise, when an accelerometer is used for receiving transducer 34, a pre-amplifier is used ahead of high pass filter 75, which can be an active filter, since the signal generated by such an accelerometer is typically small. In either case, the resultant signal is then amplified at amplifier 77, rectified by rectifier 76, and integrated by integrator 80. From there, the signal is fed to a comparator 81 being supplied with a constant reference voltage for comparison, which produces a signal when the signal from integrator 80 is above a predetermined threshold. The signals from comparator 81 are received by shift register 82 at one of two rates—either 6.25 msec between bursts representing a logic bit "1", or 12.5 msec between bursts representing a logic bit "0". The shift register 82 looks for a pattern in 12.5 msec windows and makes an inquiry at times 0 msec, 5.25 msec, 6.25 msec, and 11.5 msec. This results in 1010 being shifted into shift register 82 for a logic "1" and 1000 for a logic "0". For redundancy, this pattern is preferably repeated four times resulting in a 100 msec/bit data rate, or 10 bits/sec. These bit patterns are shifted to the pattern recognition 83 where a 5 volt signal for 1010 ("1") or a 0 volt signal for 1000 ("0") is generated and transferred to interface 84. All other patterns (e.g. 1111, 1011, and 1101 are considered generated by noise and therefore ignored, and the level remains that which was previously set until a valid pattern is recognized. The signal from interface 84 is thus the decoded signal from the sensor sub 20 that is fed to the microprocessor associated with the MWD tool 19.

As noted above, in the event sonic vibration signals are to be sent further uphole rather than to the MWD tool 19, the filtered and amplified signals from the receiver transducer 35 are used to drive a transmitting transducer like that shown in FIGS. 3 and 4 which is mounted adjacent thereto and which has its own power supply (not shown). In this manner the receiving and transmitting pairs of transducers can be mounted in short length subs that are fixed at various stations or levels in a drill string to transmit intelligible information to the surface.

OPERATION

Where the present invention is used in connection with directional drilling, the combination of tool string components shown in FIG. 1, which is an example of a commonly-used steerable system with the exception of sensor sub 20, is assembled and lowered into the borehole 10 on the drill string 9. When the mud pumps at the surface are started to initiate circulation, the power section of the drilling motor assembly 14 rotates the drive shaft that extends down through the bent housing 16 and the sensor sub 22 to where it is connected to a spindle that is attached to the bit 13. If the bent housing 16 is operated to establish a bend angle, and the drill string 9 is not rotated, the trajectory of the bit 13 will be along a curved path. Otherwise the hole can be drilled straight ahead in response to rotation of the drill string 9 which is superimposed over rotation of the output shaft of the drilling motor. The various measurements mentioned above can be made continuously or intermittently with sensor sub 20 as the hole is deepened, namely inclination and azimuth measurements, and resistivity and gamma ray measurements. Other measurements that are of interest in connection with a well drilling process also can be made, for example drive shaft rpm and tool vibration.

The signals that represent the levels of each of the various measurements are inputted to an encoder 24 which, together with the timing circuit 25, provide an encoded sequence or train of electrical excitations in the form of voltage bursts that are applied across the leads 63, 63' of the sonic transmitter 32. Such sequence can include a plurality of discrete time frames so that a certain frame represents a particular measurement, plus a starting or timing frame. The crystals 72 of transmitter 32 undergo longitudinal displacements which drive the coupling block 37 in a manner such that it generates corresponding sonic waves or vibrations in the housing of the sensor sub 20. The vibrations travel upward primarily in the walls of the bent housing 16, the housing of the mud motor 14, the walls of the drill collar 18, and other metal components which cumulatively form a transmission path to the receiving transducer 35 within the receiver sub 34. The vibrations excite the transducer 35 which produces an output signal representative of the transmitted signals. These signals are filtered, amplified and decoded by the circuits shown in FIGS. 2 and 7, with the resulting output being fed to a receive line of a microprocessor in the MWD tool 19. The internal controls of the MWD tool 19 cause it to produce modulated pressure pulses in the mud stream that are, in part, representative of each of the measurements made at the sensor sub 20. These pulses are detected at the surface, decoded, and processed so that the various values of the downhole measurements are available for analysis substantially in real time.

It has been found that the steel walls of the drill string components 16, 14 and 18 provide a reliable medium for sonic vibration-type transmission, because the attenuation is quite low, in the order of less than 6 Db per 100/Ft. over a range of frequencies between 10–25 KHz. With such low attenuation, signals can be transmitted reliably over substantial distances and still be reliably detected, provided there is no abrupt change in collar diameter, and the transmission conditions are relatively quiet, for example when there is a temporary cessation in drilling. When the drill bit 13 is turning on bottom, the various sources of background noise that are produced limit the transmission distance. However, the frequencies used in the operation of the present invention are well above the frequency range of most all of the noise that is generated while drilling, so that there is a good separation between the frequencies of the telemetering signal and the drilling noise. Preferably, transmitter 32 is operated at the resonant frequency of the ceramic crystals in the transmitter 32, which is about 25 KHz, although operation can fall in the range of between 20 and 40 KHz.

It now will be recognized that a new and improved telemetry system has been disclosed which meets all the objectives and has all the features and advantages of the present invention. Since certain changes or modifications may be made in the disclosed embodiment without departing from the inventive concepts involved, it is the aim of the appended claims to cover all such changes and modifications falling within the true spirit and scope of the present invention.

What is claimed is:

1. A transducer assembly for generating sonic vibrations and adapted to couple said vibrations into a metal member of a drill string, comprising: a body having a recess formed therein; an elongated stack of ceramic crystal members mounted in said recess and having an outer end; conductor means for applying electrical signals to said crystal members which induce strains therein that cumulatively effect longitudinal displacements of said outer end; coupling block means having one wall surface engaging said outer end of said stack and another wall surface abutting a companion wall surface of said metal member for coupling said vibrations into, said metal member; and resilient means engaging said body for forcing said stack of ceramic members and said coupling block means against said companion wall surface to provide efficient coupling of said vibrations into said member.

2. The assembly of claim 1 wherein said resilient means reacts against an outer wall of said body and allows small dimensional changes to occur that are caused by high temperatures in a well bore while maintaining said coupling block means firmly against said companion wall surface.

3. The assembly of claim 2 wherein said resilient means includes a plurality of frusto-conical spring washers; and means for mounting said washers in longitudinal alignment with said body.

4. The assembly of claim 1 further including longitudinal guide means on said coupling block means and said body for providing precise alignment thereof with respect to said companion surface.

5. The assembly of claim 1 further including adjustable means for tightening said coupling block means against said outer end of said stack of crystal members with a selected pressure.

6. The assembly of claim 1 further including means for applying spaced bursts of electrical excitations to said crystal members, each of said bursts having a selected plurality of cycles so that the repetitive rate of said bursts provides a means for encoding said sonic vibrations to represent measurements made in a well bore.

7. The assembly of claim 6 wherein said applying means comprises encoder and timing circuit means for determining said encoding.

8. The assembly of claim 7 wherein of each of said bursts includes a plurality of cycles of about 4 to provide optimum sonic energy output for a discrete amount of electrical energy input.

9. The assembly of claim 7 wherein said encoding is digital in terms of the repetition rate of respective ones of said bursts, so that a bit 1 corresponds to one of said repetition rates, and a bit 0 corresponds to another of said repetition rates.

10. The assembly of claim 6 wherein the frequency of said sonic vibrations is in the range of from 15 KHz to 40 KHz.

11. The assembly of claim 6 wherein the frequency of said sonic vibrations is about 25 KHz to discriminate against lower background noise frequencies.

12. A receiving transducer assembly for picking up sonic signals travelling through a metal member in a drill string and producing output signals that are representative thereof, comprising: a body having a recess formed therein; an elongated stack of ceramic crystal members mounted in said recess and having an outer end; conductor means for transmitting electrical signals generated by said crystal members when strains are induced therein in response to sonic vibrations; coupling block means having one wall surface engaging said outer end of said stack and another wall surface abutting a companion wall surface on said metal member for coupling sonic vibrations in said metal member into said stack of crystal members; and resilient means engaging said body for forcing said stack of crystal members and said coupling block means against said companion wall surface to provide efficient coupling of said sonic vibrations into said crystal members via said coupling block means.

13. The apparatus of claim 12 further including longitudinally spaced guides on said body and said coupling block means for providing precise longitudinal alignment of said body and said coupling block means with said companion surface.

14. The apparatus of claim 12 further including adjustable means for tightening said coupling block means against said outer end of said stack of crystal members with a selected pressure.

15. The apparatus of claim 12 wherein said resilient means is constituted by a plurality of frusto-conical spring washers; and further including means on said body and extending through said plurality of spring washers for mounting said washers in longitudinal alignment with said body.

16. The apparatus of claim 12 wherein said crystal members are alternately oriented with respect to their directions of polarization, and further including a pair of conductor wires connected respectively to the opposite sides of each of said crystal members for providing output voltage signals that are indicative of strains applied to said crystal members by said sonic vibrations.

17. The apparatus of claim 16 further including high pass filter means receiving said output signals from said crystal members and adapted to reject low energy noise signals contained therein.

18. The apparatus of claim 17 further including means for amplifying the electrical signals that pass through said filter means.

19. The apparatus of claim 18 further including means for recognizing a characteristic of said signals which represents intelligence.

20. The apparatus of claim 19 wherein said signals include time-spaced bursts of pluralities of cycles, and wherein said characteristic is the repetition rate of each of said bursts.

21. The apparatus of claim 17 further including means for amplifying the output signals from said filter means for decoding same.

22. A telemetry system for use in transmitting sonic vibrations that represent measurements made in a borehole through a portion of a drill string having metal tubular members that are connected to one another, comprising: means for producing a series of bursts of electrical excitations that are digitally encoded in accordance with said measurements to have one of two selected repetition rates, each of said bursts having a predetermined number of oscillations that are time-spaced in a manner such that no oscillation appears between bursts; means for applying said excitations to a first transducer means which includes a ceramic crystal assembly that produces sonic vibrations which correspond to said bursts; means for coupling said vibrations into one of said metal members so that said vibrations travel through the walls thereof; second transducer means on another of said metal members for sensing said vibrations and producing electrical output signals which are representative thereof; and means for decoding said output signals to produce noise avoidance.

23. The system of claim 22 further including means associated with said second transducer means for detecting the repetition rate of said output signals.

24. The system of claim 22 further including means for filtering said output signal to eliminate low energy signals, means for amplifying the output of said filtering means; and means for applying said amplified high energy signals as the excitation for another ceramic crystal assembly which produces sonic vibrations and couples them into another of said metal members for transmission further along said drill string.

25. The system of claim 22 wherein said second transducer means includes a ceramic crystal assembly that senses sonic vibrations and produces electrical output signals that are representative thereof, said last-mentioned crystal assembly being so constructed and arranged that it resonates at the carrier frequency of said transmitted signals to provide a band-pass filter effect which improves the signal-to-noise ratio.

26. The system of claim 22 wherein said second transducer means comprises meter means for sensing accelerations and providing output signals representative thereof.

27. A method of transmitting borehole measurements along a portion of a drill string that includes metal tubular members which are connected to one another, comprising the steps of: producing a series of bursts of electrical excitations that are encoded in accordance with said measurements, each of said bursts having a predetermined number of oscillations and being time-spaced in a manner such that no oscillation appears between bursts; applying said excitations to a first transducer means which includes a ceramic crystal assembly that produces sonic vibrations corresponding to said bursts; coupling said vibrations into one of said metal members so that said vibrations travel through the walls of said members; sensing said vibrations with a second transducer means on another of said metal members and producing electrical output signals which are representative thereof; and decoding said output signals to provide noise avoidance.

28. The method of claim 27 wherein the manner in which said bursts are encoded includes modulating a carrier frequency by controlling the repetition rate of said bursts of electrical excitations in a manner such that one repetition rate thereof corresponds to a 1 bit and another repetition rate corresponds to a 0 bit, both of said rates being predetermined for noise avoidance.

29. The method of claim 28 including the further step of detecting the repetition rate of the output signals from said second transducer means.

30. The method of claim 27 including the additional steps of: filtering the output signals from said second transducer means to eliminate low energy background noise signals; amplifying said filtered signals; and applying said amplified signals to a third transducer means which produces sonic vibrations and couples them into another of said metal members for transmission further along the drill string.

* * * * *